United States Patent [19]

Spreiter

[11] Patent Number: 4,836,594

[45] Date of Patent: Jun. 6, 1989

[54] APPARATUS FOR HYGIENICALLY COLLECTING FECES AND METHOD OF MANUFACTURING SAME

[76] Inventor: Franz Spreiter, Höhenweg 3, CH-4612 Wangen, Switzerland

[21] Appl. No.: 168,371

[22] Filed: Mar. 15, 1988

[51] Int. Cl.[4] ..... A01K 29/00

[52] U.S. Cl. ..... 294/1.3

[58] Field of Search ..... 383/6, 15, 93; 15/257.1; 294/1.3, 1.4, 1.5

[56] References Cited

U.S. PATENT DOCUMENTS

| | | | |
|---|---|---|---|
| 2,819,010 | 1/1958 | Amiguet | 383/93 |
| 3,459,362 | 8/1969 | Giachi | 383/15 |
| 3,739,418 | 6/1973 | Yonaites et al. | 294/1.3 |
| 3,765,044 | 10/1973 | Hanahan et al. | 294/1.3 |
| 3,806,984 | 4/1974 | Hilsabeck | 383/34 |
| 3,813,121 | 5/1974 | Marvin | 294/1.3 |
| 4,186,955 | 2/1980 | Campbell | 294/1.3 |
| 4,215,886 | 8/1980 | Naderi et al. | 294/1.3 |
| 4,272,116 | 6/1981 | Tufte, Jr. | 15/257 |
| 4,645,251 | 2/1987 | Jacobs | 294/1.3 |
| 4,741,565 | 5/1988 | Bagg | 294/1.3 |

FOREIGN PATENT DOCUMENTS

| | | | |
|---|---|---|---|
| 2100581 | 1/1983 | United Kingdom | 294/1.3 |

*Primary Examiner*—Robert A. Hafer
*Assistant Examiner*—Charles H. Sam
*Attorney, Agent, or Firm*—Ladas & Parry

[57] ABSTRACT

An apparatus for collecting feces has a glove bag, a receiving container attached to the glove bag, the receiving container having a reinforcing rim and being shaped in one piece and disposed on a closed end of the glove bag.

13 Claims, 3 Drawing Sheets

Figur 1
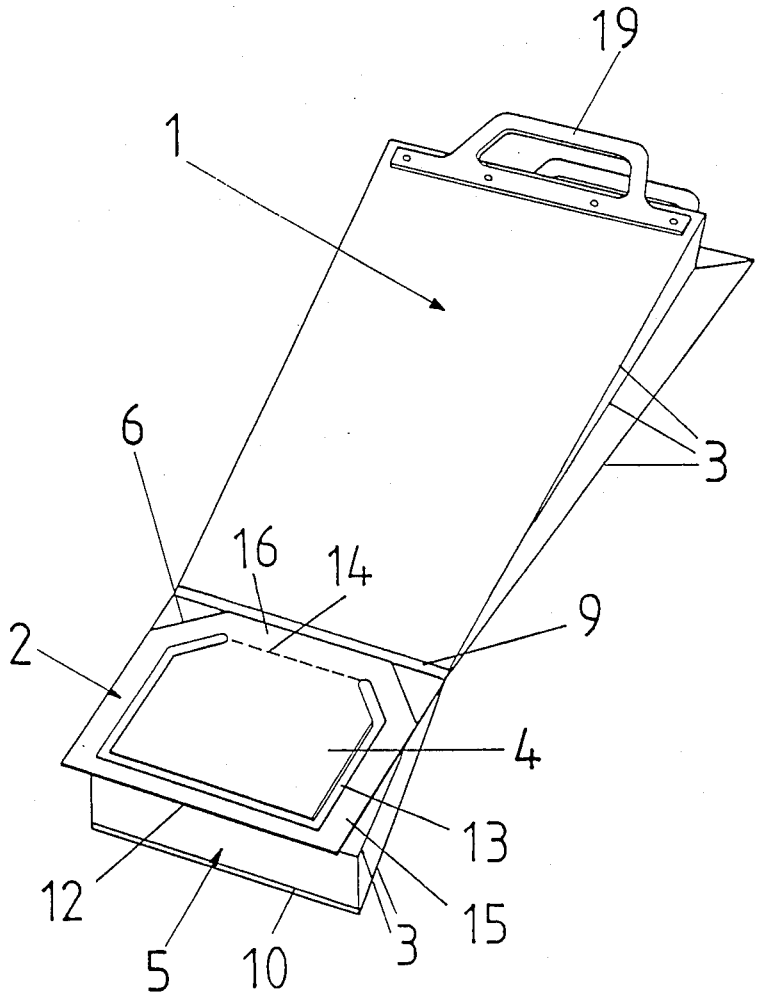

Figur 2
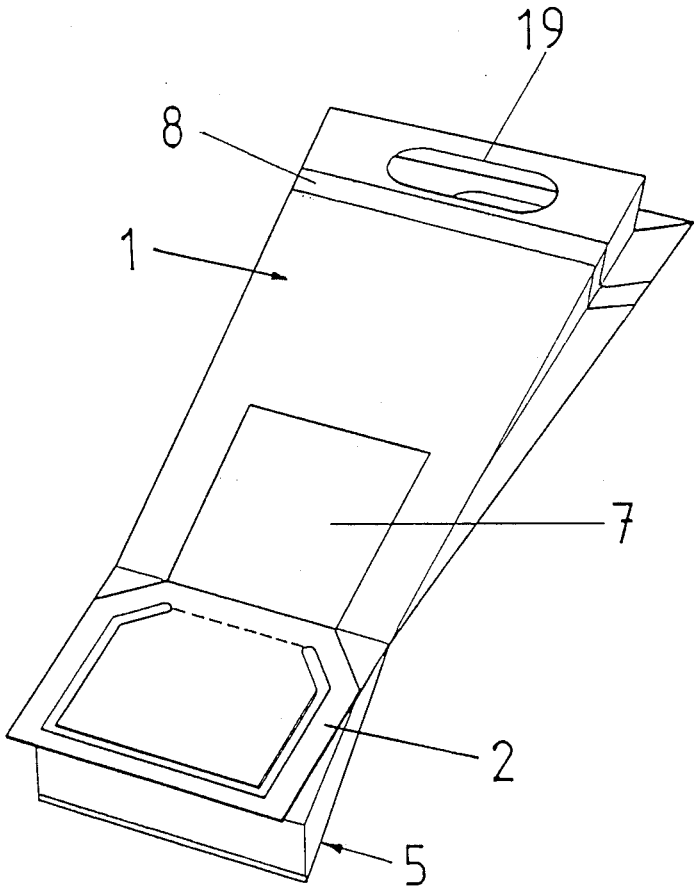

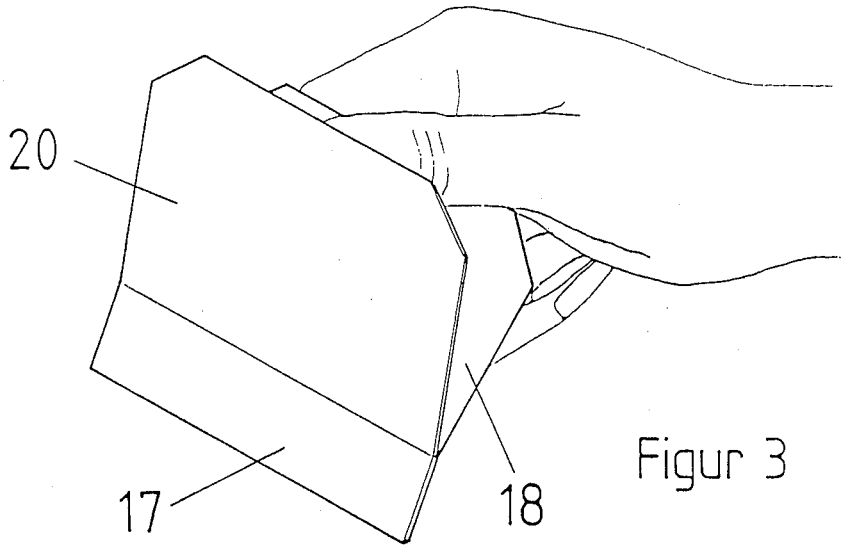
Figur 3
Figur 4
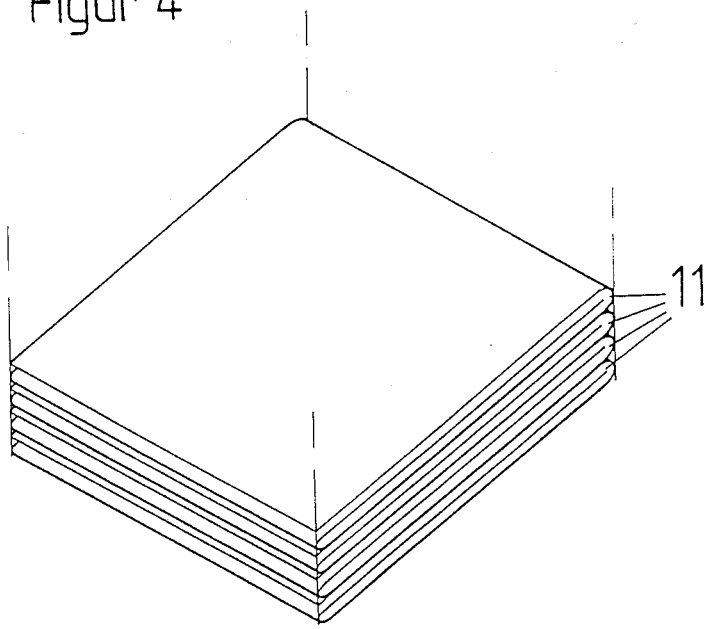

APPARATUS FOR HYGIENICALLY COLLECTING FECES AND METHOD OF MANUFACTURING SAME

TECHNICAL FIELD

The present invention relates to an apparatus for hygienically collecting feces, especially feces of domesticated pets and a method of manufacturing same.

BACKGROUND OF THE INVENTION

A number of different methods and apparatus are known in the prior art for the collecting of animal feces. For example, it is known merely to shovel the feces out of the way using, for example, a conventional shovel. That prior art technique suffers a number of disadvantages. First, the prior art technique is not particularly hygienic. Second, as people and their pets live in more densely populated neighborhoods, such as in condominium complexes, the prior art technique for collecting and disposing of animal feces becomes less and less convenient.

BRIEF DESCRIPTION

There is a need, therefore, for an inexpensive, disposable and easily portable apparatus for hygienically collecting feces. The present invention satisfies this need. The apparatus includes a glove bag and a feces receiving container which has a reinforced opening rim. The glove bag is closed and the receiving container is connected to the glove bag at the closed end thereof.

DESCRIPTION OF THE DRAWING

The novel features which are believed to be characteristic of the invention are set forth in the appended claims. The invention itself, however, both as to its construction and its method of use and manufacture, together with the object and features thereof, will be best understood from the following detailed description of an illustrative embodiment when read in conjunction with the accompanying drawing, wherein:

FIG. 1 is a prospective view of the apparatus showing the glove bag and receiving container in a slightly open or expanded position;

FIG. 2 is a prospective view of another embodiment of the invention;

FIG. 3 is a prospective and detailed view of an embodiment of a trowel belonging to the apparatus; and FIG. 4 is a perspective view of a stacked arrangement of several of the apparatuses according to the present invention, being folded in a convenient way, both for long term storage and for marketing purposes.

DETAILED DESCRIPTION

FIG. 1 is a perspective view of one embodiment of my apparatus for hygienically collecting feces. As can be seen from FIG. 1, the apparatus has a glove bag 1 and a receiving container 5 attached thereto at a cross seam 9. The receiving container 5 is tightly sealed at its other end by means of a second cross seam 10. The apparatus can be manufactured very conveniently, for example, if the glove bag 1 and receiving container 5 are manufactured from a common film tube, such as a polyethylene film tube, and, cross seams 9 and 10 are conveniently formed by making a transversely directed weld in the film tube.

The film tube forming the glove bag 1 and receiving container 5 is preferably folded flat along fold lines 3 running in the longitudinal direction on either longitudinal side of the apparatus so that the apparatus can be stored flat, and, as will be seen, can be folded or wound to form a flat pack 11 as shown in FIG. 4. The fold lines in FIG. 1 (and in FIG. 2 for that matter) are shown slightly diverging since the glove bag 1 and receiving container 5 are depicted slightly open.

The receiving container 5 is reinforced on at least one face thereof by a cardboard piece 2 which has an edge 12 directed towards the outer end of the apparatus and is spaced at an adequate distance from cross seam 10 when the apparatus is extended flat, so that in use an adequate filling volume is provided by the receiving container 5 which then expands very much like a conventional bag.

The cardboard piece 2 is secured to that portion of the film tube which it faces by conventional means. A cut line 13 is provided in the cardboard area and the cut line cuts through both the cardboard piece and the underlying portion of the film tube and thereby forms an opening for receiver container 5. The cut line 13 does not close on itself, but rather a weakening line 14 is connected between the two ends of the cut line 13. The weakening line 14 can be formed such as to permit the resulting flap 4 to be removed to serve a trowel for picking up feces or it can be constructed such that it forms a hinge 14 so that flap 4 provides a convenient means for closing receiving container 5. Using flap 4 as a closing device can be especially appropriate if the feces are infested with insects or the like since, if flap 4 is in place, the immediate closing of the receiving container 5 is easily possible.

The outer region of the cardboard piece 2 surrounding the flap region 4 is bonded to the film tube by conventional means, and thereby forms a reinforcing border or rim 15 for the receiving container 5. As a result of its flat shape, it permits a shovel like use of the container 5 if it is gripped in the vicinity of numeral 16 by the user's hand after first introducing the user's hand into the glove bag 1.

Cardboard piece 2 in the vicinity of cross seam 9 is preferably beveled at the two corner regions 6 so that after receiving container 5 has been filled, the receiving container can be conveniently pushed into the glove bag, turning the glove bag inside out and thereby completely enclosing the receiving container 5 in the glove bag 1. An attached closure device or an adhesive coating (covered, for example, by removable protective tape 8—see FIG. 2) can be provided about the outside of the glove bag 1 so that upon pushing the receiving container 5 into the glove bag 1 and thereby causing glove bag 1 to be turned inside out, the closure device or adhesive coating can be used to completely seal the receiving container 5 inside glove bag 1 (after first removing the protective tape 8). A handle 19 can be formed, or fixed, in the vicinity of the glove bag 1 to provide for a convenient means of carrying the apparatus after it has been filled and turned inside out in the manner described above.

The embodiment of FIG. 2 is rather similar to the embodiment of FIG. 1, but differs primarily in that cardboard piece 2 is provided with an extension 7 which extends beyond cross seam 9. The extension 7 provides a gripping flap which permits the more convenient use of receiving container 5 itself as a trowel and, after filling the receiving container 5, it can be flipped over and used as the primary means (if flap 4 is removed at weakening line 14) or as additional means for closing the opening in receiving container 5. This flipping over naturally occurs when the glove bag is pulled over the receiving container 5 as it is turned inside out in the manner described previously.

FIG. 3 depicts an alternate embodiment of trowel 4 after being separated from receiving container 5 along breaking line 14. The trowel 4 of FIG. 4 comprises two cardboard layers bonded together along a front trowel face 17 which has an edge 12 for conveniently sliding under a feces. Adjacent the trowel face 17 is provided a gripping flap 18 for use by the user and a second flap 20 which prevents the user's hand from being dirtied during the process of sliding under the feces.

Additionally, if desired, the user's hand can be further hygienically protected when using trowel 4 by using the separate glove bag 1 which accompanies the apparatus.

As previously indicated, a number of the apparatuses can be conveniently stored (and sold) as flat packs 11 shown in FIG. 4. Cross seam 9 forms a convenient place for one of the fold lines used in folding the apparatus into a flat pack. A piece of adheisve tape can hold the flat apparatus pieces together, so that they can be easily opened.

Having described the invention in connection with several embodiments thereof, modification will now suggest itself to those skilled in the art. The invention is not intended to be limited to the disclosed embodiments, except as required by the appended claims.

What is claimed is:

1. An apparatus for collecting feces comprising a glove bag and a receiving container shaped in one piece from a common film tube, said film tube having a channel which is closed by two transversely directed welds, one of said welds closing a distal end of the film tube, the second of said welds closing an intermediate portion of said film tube so that the size of the receiving container is defined by length of the common film tube between said two transversely directed welds, the receiving container having a receiving opening with a reinforcing rim about said opening.

2. The apparatus according to claim 1, wherein the edge of said rim closest to the distal end of the film tube is spaced from said weld closing said distal end when the apparatus is extended flat.

3. The apparatus according to claim 1, wherein said common film tube, when it is extended flat, has folds along its longitudinal edge where a portion of the film tube is tucked inwardly in itself, whereby said film tube has sufficient material in the glove bag to expand around and cover said receiving container after said receiving container has received feces.

4. The apparatus according to claim 1, wherein the reinforcing rim is provided by a cardboard sheet which is laterally bonded to said receiving container.

5. The apparatus according to claim 4, wherein the reinforcing rim is inwardly bounded by a cutting line and a weakening line which define the contour of a flap which, when separated from the apparatus, can be used as a trowel.

6. The apparatus according to claim 4, wherein the reinforcing rim is provided with a gripping flap which normally lies flat adjacent to the glove bag but which, in use, can be flipped over the opening in the receiving container.

7. The apparatus according to claim 4, further including a trowel which is surrounded by said reinforced rim and separable therefrom by means of a weakening line, the trowel having two cardboard layers which are bonded together along a front trowel face so as to define two flaps, one of which is a gripping flap and the other of which is a protective flap.

8. An apparatus for collecting feces comprising a glove bag and a receiving container shaped in one piece from a common film tube, said film tube having a channel which is closed by two transversely directed welds, one of them closing a distal end of the film tube, the second of said welds closing an intermediate portion of said film tube so that the size of the receiving container is defined by length of the common film tube between said two transversely directed welds, the receiving container having a receiving opening with a reinforcing rim about said opening, the edge of said rim closest to the distal end of the film tube being spaced from said weld closing said distal end when the apparatus is extended flat.

9. The apparatus according to claim 8, wherein the reinforcing rim is provided by a cardboard sheet which is laterally bonded to said receiving container.

10. The apparatus according to claim 9, wherein the reinforcing rim is inwardly bounded by a cutting line and a weakening line which define the contour of a flap which, when separated from the apparatus, can be used as a trowel.

11. The apparatus according to claim 9, wherein the reinforcing rim is provided with a gripping flap which normally lies flat adjacent to the glove bag but which, in use, can be flipped over the opening in the receiving container.

12. The apparatus according to claim 9, further including a trowel which is surrounded by said reinforced rim and separable therefrom by means of a weakening line, the trowel having two cardboard layers which are bonded together along a front trowel face so as to define two flaps, one of which is a gripping flap and the other of which is a protective flap.

13. The apparatus according to claim 8, wherein said common film tube, when it is extended flat, has folds along its longitudinal edge where a portion of the film tube is tucked inwardly in itself, whereby said film tube has sufficient material in the glove bag to expand around and cover said receiving container after said receiving container has received feces.

* * * * *